United States Patent [19]

Takahashi et al.

[11] Patent Number: 5,049,205

[45] Date of Patent: Sep. 17, 1991

[54] PROCESS FOR PREPARING UNIDIRECTIONAL SILICON STEEL SHEET HAVING HIGH MAGNETIC FLUX DENSITY

[75] Inventors: Nobuyuki Takahashi; Katsuro Kuroki; Yozo Suga; Kiyoshi Ueno, all of Fukuoka, Japan

[73] Assignee: Nippon Steel Corporation, Tokyo, Japan

[21] Appl. No.: 589,338

[22] Filed: Sep. 27, 1990

[30] Foreign Application Priority Data

Sep. 28, 1989 [JP] Japan ..... 1-253518
May 22, 1990 [JP] Japan ..... 2-131675

[51] Int. Cl.[5] ..... H01F 1/047
[52] U.S. Cl. ..... 148/111; 148/112; 148/113; 148/307
[58] Field of Search ..... 148/111, 112, 113, 307

[56] References Cited

U.S. PATENT DOCUMENTS 4,863,532 9/1989 Kuroki et al. ..... 148/307
4,938,807 7/1990 Takahashi et al. ..... 148/111

FOREIGN PATENT DOCUMENTS 62-40315 2/1987 Japan .

OTHER PUBLICATIONS

J. E. May and D. Turnbull, (Trans. Met Soc. AIME 212(1958), pp. 769-781.

*Primary Examiner*—R. Dean
*Assistant Examiner*—Sikyin Ip
*Attorney, Agent, or Firm*—Kenyon & Kenyon

[57] ABSTRACT

The present invention relates to a process for preparing a unidirectional silicon steel sheet having a high magnetic flux density which comprises heating a silicon steel slab comprising by weight 0.025 to 0.075% of carbon, 2.5 to 4.5% of silicon, 0.015% or less of sulfur, 0.010 to 0.050% of acid-soluble aluminum, 0.0010 to 0.012% of nitrogen, 0.050 to 0.45% of manganese and 0.01 to 0.10% of tin and optionally 0.0005 to 0.0080% of boron with the balance being iron and unavoidable impurities, at 1200° C. or below; hot-rolling the slab; subjecting the slab to rolling once or two or more times wherein intermediate annealing is provided, thereby attaining a percentage final rolling of 80% or more; subjecting the resultant steel sheet to decarburizing annealing in a wet hydrogen atmosphere; coating the steel sheet with an annealing separator; conducting finishing annealing for secondary recrystallization and purification of the steel; and subjecting the steel sheet to a nitriding treatment between after the ignition for decarburizing annealing and before the initiation of the secondary recrystallization in the finishing annealing.

4 Claims, 1 Drawing Sheet

PROCESS FOR PREPARING UNIDIRECTIONAL SILICON STEEL SHEET HAVING HIGH MAGNETIC FLUX DENSITY

BACKGROUND OF THE INVENTION (1) Field of the Invention

The present invention relates to a process for preparing a unidirectional silicon steel sheet used for an iron core of electrical machinery and apparatus. The process of the present invention enables the preparation of a unidirectional silicon steel sheet having a high magnetic flux density.

(2) Description of the Prior Art

A unidirectional silicon steel sheet comprises grains having a Goss orientation wherein the steel plate surface has {1 1 0}face and the rolling direction has <1 0 0>axis ({1 1 0}<0 0 1>orientation in terms of Miller's indices), and is used as a soft magnetic material in an iron core of a transformer and a generator, and this steel sheet should have excellent magnetizing characteristics and iron loss characteristics, among the required magnetic characteristics. The magnetizing characteristics are determined by the magnetic flux density induced within the iron core in an applied given magnetic field, and in a product having a high magnetic flux density, the size of the iron core can be reduced. A high magnetic flux density can be attained by precisely orientating the steel plate grain to {1 1 0}<0 0 1>.

The iron loss is a power loss consumed as a thermal energy when a predetermined alternating current is applied to an iron core, and is influenced by the magnetic flux density, sheet thickness, amount of impurities, specific resistance, and size of grain, etc.

The steel sheet having a high magnetic flux density is preferred because not only can the size of the iron core of an electrical machinery and apparatus be reduced but also the iron loss becomes small. Therefore, there is a need in the art for the development of a process which enables a product having the possible highest magnetic flux density to be prepared at a low cost.

A unidirectional silicon steel plate is prepared by a secondary recrystallization, wherein a steel sheet prepared by subjecting a hot rolled sheet to a proper combination of cold rolling with annealing, to a final sheet thick.ness, is subjected to finishing annealing to selectively grow a primarily recrystallized grain having {110}<001>orientation. The secondary recrystallization is achieved when fine precipitates, e.g., MnS, AlN, MnSe, BN and (Al, Si)N, or elements present at grain boundaries, such as Sn and Sb, are present in the steel sheet before the secondary recrystallization. As described in J.B. May and D. Turnbull (Trans. Met. Soc. AIME 212 (1958), pp. 769-781), these precipitates and elements present at grain boundaries serve to selectively grow grains having {110}<001>orientation through suppression of the growth of primarily recrystallized grains having an orientation other than {110}<001> orientation in the step of finishing annealing. The above-described effect of suppressing the growth of grains is generally called the "inhibitor effect". Accordingly,, the main thrust of research and development in the art is toward the determining of what kind of precipitate or element present at grain boundaries should be used to stabilize the secondary recrystallization and how to achieve a proper state of existence of the above-described precipitate and element for enhancing the proportion of the existence of grains having an exact {110}<001>orientation. The method wherein use is made of only one precipitate has a limit on the control of {110}<001>orientation with a high accuracy. Therefore, in recent years, technical developments have been conducted to obtain a stable production of a product having a higher magnetic flux density, at a lower cost, through a thorough elucidation of the drawbacks and advantages of each precipitate, and an organic combination of several precipitates.

Currently, three representative processes for preparing a unidirectional silicon steel sheet on a commercial scale are known in the art, and each have advantages and disadvantages. The first technique is a double cold rolling process disclosed in Japanese Examined Patent Publication No. 30-3651 by M.F. Littmann wherein use is made of MnS. In this process, the resultant secondarily recrystallized grain is stably grown, but a high magnetic flux density is not obtained. The second technique is a process disclosed in Japanese Examined Patent Publication No. 40-15644 by Taguchi et al., wherein a combination of AlN with MnS is used to attain a draft as high as 80% or more in the final cold rolling. In this process, although a high magnetic flux density is obtained, a close control of production conditions is necessary for production of a commercial scale. The third technique is a process disclosed in Japanese Examined Patent Publication No. 51-13469 by Imanaka et al. wherein a silicon steel containing MnS (and/or MnSe) and Sb is produced by the double cold rolling process. In this process, although a relatively high magnetic flux density is obtained, the production cost becomes high due to the use of harmful and expensive elements, such as Sb and Se, and double cold rolling. The above-described three techniques have the three following problems in common. Specifically, in all of the above-described techniques, to finely and homogeneously control the precipitate, prior to the hot rolling, the slab is heated at a very high temperature, i.e., in the first technique at 1260° C. or above, in the second technique at 1350° C. when the silicon content is 3% although the temperature depends on the silicon content of the material as described in Japanese Unexamined Patent Publication No. 48-51852, in the third technique at 1230° C. or above and 1320° C. in the example wherein a high magnetic flux density is obtained as described in Japanese Unexamined Patent Publication No. 51-20716, thereby once melting the coarse precipitate to form a solid solution, and the precipitation is conducted during subsequent hot rolling or heat treatment. An increase in the slab heating temperature brings the problems of an increase in the energy used during heating of the slab, a lowering of the yield, and an increase in the repair cost of the heating furnace due to slag, a lowering in the operating efficiency attributable to an increase in the frequency of the repair of the heating furnace, and an inability to use a continuous cast slab due to occurrence of poor secondary recrystallization region in streak, recrystallization as described in Japanese Examined Patent Publication No. 57-41526. A more important consideration than the cost is that a large content of silicon and a thin product sheet thickness for a reduction of the iron loss brings an increase in the occurrence of the above-described poor secondary recrystallization region in streak, and thus a further reduction of the iron loss cannot be expected from the technique using the high temperature slab heating method. On the other hand, in the technique disclosed in Japanese Examined Patent Publication No. 61-60896, the sulfur content of the steel is reduced to stabilize the secondary recrystallization, which enables a product having a high silicon content and a small thickness to be prepared. Neverthe.less, when the production on a commercial scale is taken into consideration, this technique has a problem with regard to the stability of the magnetic flux density, and accordingly, an improved technique was proposed as described in, for example, Japanese Unexamined Patent Publication No. 62-40315. To date, however, a satisfactory solution to the above problem has not been found.

As described above, in the current industrial process, an inhibitor necessary for the secondary recrystallization is added in the step prior to cold rolling. By contrast, the present invention relates to a process based on the same technical concept as that disclosed in Japanese Unexamined Patent Publication No. 62-40315. Specifically, the inhibitor necessary for the secondary recrystallization is formed in situ between after the completion of the decarburizing annealing (primary recrystallization) and before the development of the secondary recrystallization in the finishing annealing. This is achieved by infiltrating nitrogen into the steel to form (Al, Si)N serving as an inhibitor. The infiltration of nitrogen may be conducted by the prior art method wherein the infiltration of nitrogen from the atmosphere in the step of increasing the temperature during finishing annealing is utilized or a strip is exposed to a gas atmosphere capable of serving as a nitriding atmosphere, such as NH , in the post-region of the decarburizing annealing or after the completion of decarburizing annealing.

To homogenize the nitriding treatment, an attempt has been made to carry out a nitriding treatment of a steel in the form of a loose strip coil. This method, however, is still unsatisfactory because problems arise such as a heterogeneous nitriding and unstable glass coating, depending upon conditions such as the surface state of the steel sheet, properties of the annealing separator, and additives.

SUMMARY OF THE INVENTION

An object of the present invention is to obtain better magnetic characteristics through an improvement in the method of forming in situ an inhibitor necessary for the secondary recrystallization, in the step after the completion of the decarburizing annealing.

Another object of the present invention is to conduct the nitriding treatment after ignition for decarburizing annealing in a more stable state.

To attain the above-described object, the present inventors have conducted further detailed studies on the prior art, and as a result, have confirmed that the amount of oxygen of an oxide formed on the surface of the steel sheet during decarburizing annealing and continuous nitriding annealing and the amount and quality of the oxide film formed by additional oxidation in the step of raising the temperature for finishing annealing has a great effect on the nitriding by a gas atmosphere and omission of the inhibitor in the subsequent step of finishing annealing and the step of forming glass coating, and newly found that the magnetic characteristics and glass coating characteristics in the final product can be remarkably improved through the control of the above-described parameters.

The control of the oxygen content of the oxide formed on the surface of the steel sheet is usually conducted by regulating the dew point of the gas atmosphere during the decarburizing annealing and the amount of water carried by annealing separator, but the variation in the oxygen content cannot be avoided, depending upon the contents of ingredients of the steel, such as Mn, Si, Al, and Cr, or the surface property of the steel sheet.

The present invention aims at a reduction in the above-described variation, and it has been confirmed that the addition of a small amount of tin to the steel enables the above-described problems to be solved, thereby attaining the above-described object.

According to the present invention, there is provided a process for preparing a unidirectional silicon steel sheet having a high magnetic flux density which comprises heating a silicon steel slab comprising by weight 0.025 to 0.075% of carbon, 2.5 to 4.5% of silicon, 0.015% or less of sulfur, 0.010 to 0.050% of acid-soluble aluminum, 0.0010 to 0.012% of nitrogen, 0.050 to 0.45% of manganese and 0.01 to 0.10% of tin with the balance being iron and unavoidable impurities, at 1200° C. or below; hot-rolling the slab; subjecting the slab to rolling once or two or more times wherein intermediate annealing is provided, thereby attaining a percentage final rolling of 80% or more; subjecting the resultant steel sheet to decarburizing annealing in a wet hydrogen atmosphere; coating the steel sheet with an annealing separator; conducting finishing annealing for secondary recrystallization and purification of the steel; and subjecting the steel to a nitriding treatment between after the ignition for decarburizing annealing and before the initiation of the secondary recrystallization in the finishing annealing.

The method wherein tin is added to a silicon steel containing AlN as a basic inhibitor is disclosed in, e.g., Japanese Unexamined Patent Publication No. 53-134722. The object of this method is to reduce the size of secondarily recrystallized grains. Further, as is apparent from the working examples, this method is based on the conventional idea of heating of slab at a high temperature (slab heating temperature: 1350° C.).

In the process of the present invention, if the amount of tin falls within the optimum amount range (0.1% exclusive to 0.5%) described in the claim of the above-described publication, the nitriding after decarburizing annealing is suppressad, which makes it difficult to form an inhibitor in situ, so that little growth of the secondarily recrystallized grains occurs.

In the present invention, tin is used for the purpose of attaining the maximum nitriding effect through a reduction in the variation in the content of oxygen present in the steel sheet after decarburizing annealing, and the addition of tin in a large amount is unfavorable.

DESCRIPTION OF THE PREFERRED EMBODIMENTS

Figure 1:
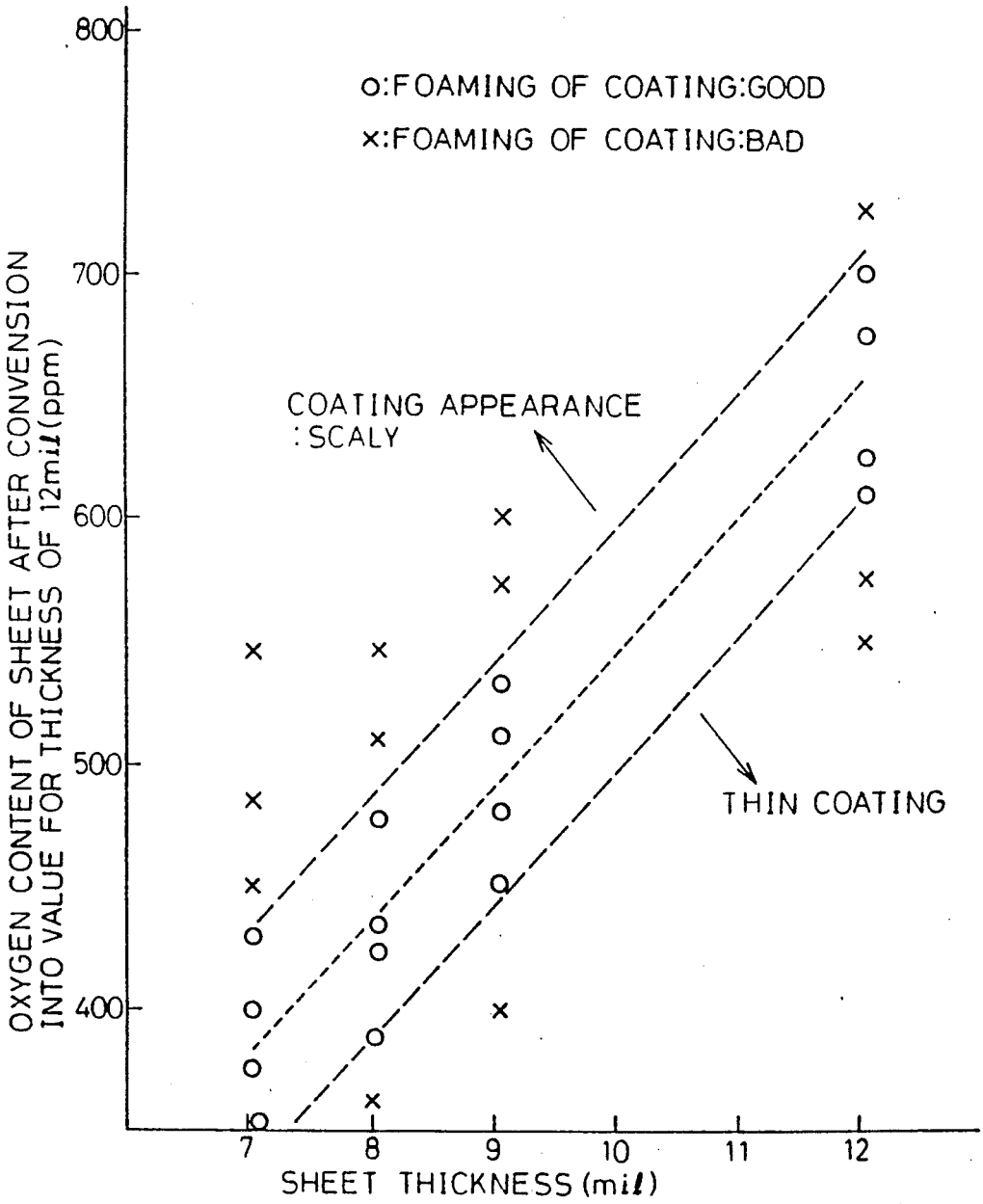
FIG. 1 is a graph showing the relationship between the amount of oxygen after decarburizing annealing and the state of coating formation after finishing annealing.

The present invention will now be described by way of experimental results.

Five ingots, i.e., an ingot comprising 0.050% of carbon, 3.3% of silicon, 0.14% of manganese, 0.008% of sulfur, 0.028% of acid-soluble aluminum, 0.0080% of nitrogen and 0.080% of chromium with the balance being iron and unavoidable impurities, and four ingots comprising the above ingredients with tin in amounts changed to 0.03%, 0.07%, 0.10% and 0.15%.

The ingots were heated at 115° C., hot-rolled, annealed at 1120° C., pickled, and ccld-rolled to prepare a cold-rolled sheet having a thickness of 0.29 mm.

Then, the sheets were subjected to decarburizing annealing in an atmosphere comprising 25% of nitrogen and 75% of hydrogen with the dew pcint changed to 55° C., 60° C. and 65° C.

Thereafter, the sheets were ccated with a slurry comprising MgO and added thereto 5% of TiO2 and 5% of manganese ferronitride, dried and subjected to final annealing at 1200° C. for 20 hr. The amount of oxygen in the surface oxide film was chemically analyzed.

The results are shown in Table 1. As is apparent from Table 1, as the amount of addition of tin increases, the amount of oxygen after the decarburizing annealing decreases and the sheet is less susceptible to the dew point. The amount of addition of tin which provides a product excellent in the magnetic characteristics as well as in the coating was 0.03%, 0.07% and 0.10%.

When no tin is added, the sheet is susceptible to the dew point and the magnetic characteristics are unstable (it is difficult to maintain the low dewpoint.) On the other hand, when the amount of addition is as large as 0.15%, there is a tendency for not only the growth of the secondarily recrystallized grain to become poor, due to a suppression of the nitriding in the step of raising the temperature for finishing annealing, but also for the coating formation to become unsatisfactory.

Thus, the addition of a small amount of tin facilitates the control of the content of oxygen in the oxide after the decarburizing annealing, and thus it became possible to prepare a product havir'g excellent magnetic characteristics and coating characteristics.

TABLE 1

| Amout of addition of tin (%) | Dew point (°C.) | Convert of oxygen in sheet after decarburizing annealing (ppm) | Coating appearance | Magnetic characteristics $B_8$ (T) | Magnetic characteristics $W_{17/50}$ (w/kg) | Classification |
|---|---|---|---|---|---|---|
| Free | 55 | 660 | ○ good | 1.94 | 0.98 | Comp. Ex. |
| | 60 | 720 | Δ scaly | 1.91 | 1.05 | |
| | 65 | 810 | x " | 1.90 | 1.10 | |
| 0.03 | 55 | 640 | ○ good | 1.94 | 0.96 | Ex. of |
| | 60 | 670 | ○ " | 1.94 | 0.99 | present |
| | 65 | 700 | ○ " | 1.93 | 1.01 | invention |
| 0.07 | 55 | 610 | ○ " | 1.93 | 0.98 | Ex. of |
| | 60 | 630 | ○ " | 1.94 | 0.96 | present |
| | 65 | 650 | ○ " | 1.94 | 0.98 | invention |
| 0.10 | 55 | 605 | ○ " | 1.93 | 0.98 | Ex. of |
| | 60 | 615 | ○ " | 1.93 | 0.97 | present |
| | 65 | 620 | ○ " | 1.94 | 0.97 | invention |
| 0.15 | 55 | 540 | Δ thin | 1.85 | defects in secondary recrystallization | Comp. Ex. |
| | 60 | 560 | Δ " | 1.85 | defects in secondary recrystallization | |
| | 65 | 560 | Δ " | 1.87 | defects in secondary recrystallization | |

The reason for the limitation of each ingredient in the present invention will now be described.

When the carbon content is less than 0.025%, the secondary recrystallization becomes unstable and the magnetic flux density (B8 value) of the product is as low as less than 1.80T even when the secondary recrystallization occurs.

On the other hand, when the carbon content is excessively large and exceeds 0.075%, the decarburizing annealing time becomes very long, so that the productivity is remarkably lowered.

When the silicon content is less than 2.5%, it is difficult to prepare a product having a low iron loss. On the other hand, when the silicon content is excessively large and exceeds 4.5%, cracking and breaking frequently occur during cold rolling of the material, which makes it impossible to stably conduct the cold rolling operation.

One of the features of the component system of the starting material in the present invention is that the sulfur content is 0.015% or less, preferably 0.010% or less. In the prior art, e.g., a technique disclosed in Japanese Examined Patent Publication No. 40-15644 or Japanese Examined Patent Publicatic'n No. 47-25250, sulfur was indispensable as an element for forming MnS which is one of the precipitates necessary for bringing about the secondary recrystallization. In the above-described prior art, the amount range of sulfur in which sulfur exhibits the maximum effect exists and is specified as an amount capable of dissolving MnS as a solid solution in the step of heating the slab. In the present invention, however, (Al, Si)N is used as an inhibitor, and MnS is not particularly necessary. Conversely, the increase in the MnS is unfavorable from the viewpoint of the magnetic characteristics. Therefore, in the present invention, the sulfur content is 0.015% or less, preferably 0.010% or less.

Aluminum combines with nitrogen to form AlN. Nitriding of steel in the post-treatment, i.e., after the completion of the primary recrystallization to form (Al, Si)N is essential to the present invention, which makes it necessary for the amount of free aluminum to be a certain value or more. For this reason, aluminum is added as sol.Al in an amount of 0.010 to 0.050%.

When the manganese content is excessively low the secondary recrystallization is unstable, and when the content is excessively high, it becomes difficult to prepare a product having a high magnetic flux density. The proper content of manganese is 0.050 to 0.45%.

When the nitrogen content is less than 0.0010%, the growth of the secondarily recrystallized grain becomes insufficient. On the other hand, when the content exceeds 0.0120%, a blistering of the steel sheet occurs.

Boron is effective for obtaining a high B8 value particularly when a product having a sheet thickness as thin as 0.23 mm is prepared, and the proper range is 0.0005 to 0.0080%.

An explanation will now be given with regard to the tin which is one of the features of the present invention.

When the tin content is less than 0.01%, no effect for regulating the amount of oxygen can be attained. On the other hand, when the content exceeds 0.10%, the nitriding is suppressed and the growth of the secondarily recrystallized grain becomes poor.

No problem occurs when very small amounts of chromium, copper, antimony, nickel, etc. are contained in addition to the above-described elements.

With respect to the slab heating temperature, the secondary recrystallization occurs in the case of the conventional high temperature slab heating wherein the inhibitor is dissolved to form a solid solution as well as in the case of the slab heating at a.low temperature comparable to that employed in common steel, at which it has been considered to be impossible to achieve the secondary recrystallization. Nevertheless, the heating of the slab at 1200° C. or above, which produces no slag, is preferred because the cracking in the hot rolling can be reduced and the slab heating at a low temperature which requires only a smaller amount of thermal energy is obviously advantageous.

In the step after the hot rolling, it is preferred that, after annealing for a short period of time, the sheet be subjected to cold rolling at a high percentage rolling of 80% or more to achieve a predetermined final sheet thickness for the purpose of obtaining the highest B8 value, but the annealing of the hot-rolled sheet may be omitted for the purpose of reducing the cost, although in this case the characteristics are slightly deteriorated. Further, to reduce the size of the crystal grain, a step including an intermediate annealing may be used.

Then, decarburizing annealing is conducted in a wet hydrogen gas atmosphere or a wet mixed gas atmosphere comprising hydrogen and nitrogen. There is no particular limitation on the temperature of decarburizing annealing, but the temperature is preferably 800 to 900° C.

The reason for the limitation of the desired oxygen content for each sheet thickness will now be described.

FIG. 1 is a graph showing the relationship for each sheet thickness between the oxygen content after the decarburizing annealing and the state of coating formation after finishing annealing.

The oxygen content is expressed as a value after conversion of the analytical value for each sheet thickness into a value for a thickness of 12 mil.

In the experiment, a hot-rolled sheet with the amount of the addition of tin changed from 0 to 0.07% was annealed, pickled, cold-rolled to prepare coldrolled sheets having respective final sheet thicknesses of 0.30 mm (12 mil), 0.23 mm (9 mil), 0.20 mm (8 mil) and 0.17 mm (7 mil), and subjected to decarburizing annealing.

The oxygen content of the sheet after decarburizing annealing was changed depending upon the tin content and the dew point of the gas atmosphere. Thereafter, the sheet was coated with an annealing separator composed mainly of MgO and TiO2 and subjected to finishing annealing at 1200° C. for 20 hr. As is apparent from the drawing, an excellent coating can be prepared when the oxygen content is $[O]=55t \pm 50$ (ppm) wherein t is a sheet thickness (mil). The reason for this is as follows. The thinner the sheet thickness, the larger the increase in the amount of the annealing separator composed mainly of MgO. In this case, the amount of water carried during finishing annealing increases, and the additional oxidation increases. It is believed that this is balanced by reducing the oxygen content after decarburizing annealing.

A mere lowering of the dew point of the gas atmosphere in the finishing annealing is limited as a means of reducing the oxygen content, and therefore, it is preferred to attain this object through an increase in the tin content.

Thereafter, the sheet is coated with an annealing releasing agent and subjected to finishing annealing at a high temperature (usually at 1100 to 1200° C.) for a long period of time. The most preferred embodiment of the nitriding in the present invention is to conduct the nitriding in the above-described step of raising the temperature for finishing annealing. This enables an inhibitor necessary for the secondary recrystallization to be formed in situ. For this purpose, a suitable amount of a compound having a nitriding capability, for example, MnN or CrN, is added to the annealing separator. Alternatively, a gas having a nitriding capability, such as NH3, may be added to a gas In another embodiment of the nitriding in the present invention, the nitriding is conducted in a gas atmosphere having a nitriding capability after ignition for decarburizing annealing. Alternatively, the sheet may be passed through a separately provided heat treatment oven after decarburizing annealing. Further, the above-described different means may be combined for nitriding.

After the completion of the secondary recrystallization, the annealing for purification is conducted in a hydrogen atmosphere.

EXAMPLE

Example 1

Ingots comprising as basic ingredients 0.054% of carbon, 3.25% of silicon, 0.12% of manganese, 0.007% of sulfur, 0.030% of acid-soluble aluminum and 0.0080% of nitrogen and further tin having varied contents, i.e., (1) <0.001%, (2) 0.02%, (3) 0.05% and (4) 0.12%.

These ingots were heated at 1150° C. and hot-rolled to prepare hot-rolled sheets having a thickness of 2.0 mm. The hot-rolled sheets were cut, subjected to annealing at 1120° C. for 2.5 min and then at 900° C. for 2 min, cooled in a hot water of 100° C., pickled and cold-rolled to a thickness of 0.23 mm. Then, decarburizing annealing was conducted at 830° C. for 90 sec in a wet hydrogen-nitrogen atmosphere having a dew point of 55° C. Thereafter, the sheets were coated with an annealing releasing agent comprising a slurry of MgO mixed with 5% of TiO2 and 5% of manganese ferronitride and then subjected to finishing annealing at 1200° C. for 20 hr.

The magnetic characteristics and coating appearance were as shown in Table 2.

As apparent from Table 2, the sheets respectively having tin contents of 0.02% and 0.05% had excellent magnetic characteristics and coating characteristics.

TABLE 2

| | Sn (%) | $B_8$ (T) | $W_{17/50}$ (w/kg) | Oxygen content of decarburized sheet after conversion into value for thickness of 12 mil (ppm) | Coating appearance |
|---|---|---|---|---|---|
| (1) | <0.001 | 1.93 | 0.93 | 600 | (1) Δ scaly |
| (2) | 0.02 | 1.94 | 0.88 | 520 | (2) ○ |

TABLE 2-continued

| | Sn (%) | $B_8$ (T) | $W_{17/50}$ (w/kg) | Oxygen content of decarburized sheet after conversion into value for thickness of 12 mil (ppm) | Coating appearance |
|---|---|---|---|---|---|
| (3) | 0.05 | 1.94 | 0.85 | 470 | (3) ∘ |
| (4) | 0.12 | 1.87 | incomplete secondary crystallization | 380 | (4) Δ thin |

EXAMPLE 2

A 1.6 mm-thick hot-rolled sheet comprising 0.050% of carbon, 3.45% of silicon, 0.080% of manganese, 0.010% of sulfur, 0.027% of acid-soluble aluminum, 0.0080% of nitrogen and 0.07% of tin with the balance consisting essentially of iron was heat-treated at 1120° C. for 2.5 min and then at 900° C. for 2 min and cooled in hot water of 100° C.

Thereafter, the sheet was pickled, cold-rolled to a thickness of 0.17 mm and subjected to decarburizing annealing at 830° C. for 70 sec in a wet hydrogen-nitrogen atmosphere having a dew point of 55° C.

Then, a nitriding treatment was conducted in a hydrogen-nitrogen gas containing 1% of ammonia at 750° C. for 30 sec. The nitrogen content of the steel sheet in this case was 200 ppm.

Subsequently, the sheet was coated with an annealing releasing agent composed mainly of MgO and TiO2 and then subjected to finishing annealing at 1200° C. for 20 hr.

The magnetic characteristics were as follows.

| $B_8$ (T) | $W_{17/50}$ (w/kg) | $W_{13/50}$ (w/kg) |
|---|---|---|
| 1.93 | 0.82 | 0.41 |

EXAMPLE 3

A 1.4 mm-thick hot-rolled sheet comprising 0.050% of carbon, 3.3% of silicon, 0.080% of manganese, 0.009% of sulfur, 0.027% of acid-soluble aluminum, 0.0075% of nitrogen, 0.07% of tin and 0.0020% of boron with the balance consisting essentially of iron was heat-treated at 1000° C. for 2.5 min and then at 900° C. for 2 min and cooled in hot water of 80° C.

Thereafter, the sheet was pickled, cold-rolled to a thickness of 0.14 mm and subjected to decarburizing annealing at 820° C. for 70 sec in a wet hydrogen-nitrogen atmosphere having a dew point of 55° C.

Then, the sheet was subjected to a nitriding treatment in a hydrogen-nitrogen mixed gas containing 1% of ammonia at 750° C. for 30 sec to have a nitrogen content of 180 ppm.

Subsequently, the sheet was coated with an annealing releasing agent composed mainly of MgO and TiO2 and then subjected to finishing annealing at 1200° C. for 20 hr.

The magnetic characteristics were as follows.

| $B_8$ (T) | $W_{13/50}$ (w/kg) | $W_{13/50}$ (w/kg) after control of magnetic domain |
|---|---|---|
| 1.94 | 0.42 | 0.32 |

EXAMPLE 4

A slab comprising 0.054% of carbon, 3.4% of silicon, 0.120% of manganese, 0.006% of sulfur, 0.030% of acid-soluble aluminum, 0.0072% of nitrogen and 0.05% of tin with the balance consisting essentially of iron was heat-treated at 1150° C. and hot-rolled to prepare a hot-rolled sheet having a thickness of 2.3 mm. Thereafter, the sheet was pickled, cold-rolled to a thickness of 0.34 mm and subjected to decarburizing annealing at 840° C. for 150 sec in a wet hydrogen-nitrogen atmosphere having a dew point of 60° C.

Then, the sheet was subjected to a nitrid treatment in a hydrogen-nitrogen mixed gas con ammonia at 750° C. for 30 sec to have a nitrogen content of 200 ppm.

Subsequently, the sheet was coated with an annealing releasing agent composed mainly of MgO and TiO2 and then subjected to finishing annealing at 1200° C. for 20 hr.

The magnetic characteristics were as follows.

| $B_8$ (T) | $W_{13/50}$ (w/kg) |
|---|---|
| 1.90 | 1.17 |

In the process wherein the annealing of hot-rolled sheet has been omitted, the product having a thickness of 0.34 mm exhibited an excellent iron loss.

We claim:

1. A process for preparing a unidirectional silicon steel sheet having a high magnetic flux density which comprises heating a silicon steel slab comprising by weight 0.025 to 0.075% of carbon, 2.5 to 4.5% of silicon, 0.015% or less of sulfur, 0.010 to 0.050% of acid-soluble aluminum, 0.0010 to 0.012% of nitrogen, 0.050 to 0.45% of manganese and 0.01 to 0.10% of tin with the balance being iron and unavoidable impurities, at 1200° C. or below; hot-rolling the slab; subjecting the slab to rolling once or two or more times wherein an intermediate annealing is provided, thereby attaining a percentage final rolling of 80% or more; subjecting the resultant steel sheet to decarburizing annealing in a wet hydrogen atmosphere; coating the steel sheet with an annealing separator; conducting finishing annealing for secondary recrystallization and purification of the steel; and subjecting the steel sheet to a nitriding treatment between after the ignition for decarburizing annealing and before the initiation of the secondary recrystallization in the finishing annealing.

2. A process for preparing a unidirectional silicon steel sheet having a high magnetic flux density which comprises heating a silicon steel slab comprising by weight 0.025 to 0.075% of carbon, 2.5 to 4.5% of silicon, 0.015% or less of sulfur, 0.010 to 0.050% of acid-soluble aluminum, 0.0010 to 0.012% of nitrogen, 0.050 to 0.45% of manganese, 0.0005 to 0.0080% of boron and 0.01 to 0.10% of tin with the balance being iron and unavoidable impurities, at 1200° C. or below; hot-rolling the slab; subjecting the slab to rolling once or two or more times wherein intermediate annealing is provided, thereby attaining a percentage final rolling of 80% or more; subjecting the resultant steel sheet to decarburizing annealing in a wet hydrogen atmosphere; coating the steel sheet with an annealing separator; conducting finishing annealing for secondary recrystallization and purification of the steel; and subjecting the steel sheet to a nitriding treatment between after the ignition for decarburizing annealing and before the initiation of the secondary recrystallization in the finishing annealing.

3. A process according to claim 1, wherein the oxygen content of the steel sheet after decarburizing annealing is regulated to ppm after conversion into a value for a sheet thickness of 12 mil $=55t \pm 50$ wherein t is the sheet thickness in mil.

4. A process according to claim 2, wherein the oxygen content of the steel sheet after decarburizing annealing is regulated to ppm after conversion into a value for a sheet thickness of 12 mil $=55t \pm 50$ wherein t is the sheet thickness in mil.

* * * * *

UNITED STATES PATENT AND TRADEMARK OFFICE

CERTIFICATE OF CORRECTION

PATENT NO. : 5,049,205

DATED : September 17, 1991

INVENTOR(S) : Nobuyuki TAKAHASHI, et al.

It is certified that error appears in the above-identified patent and that said Letters Patent is hereby corrected as shown below:

Column 1, line 30, delete "a" before "thermal".

Column 1, line 62, delete one of the commas after "ingly".

Column 2, line 25, change "of" to --on--.

Column 5, line 3, change "115°" to --1150°--.

Column 5, line 4, change "ccld-rolled" to --cold-rolled--.

Column 5, line 10, change "ccated" to --coated--.

Column 5, line 34, change "havir'g" to --having--.

Column 5, line 39, change "Convert" to --Conversion--.

Column 6, line 11, change "Publicatic'n" to --Publication--.

Column 6, line 63, change "B8" to --$B_8$--.

Column 7, line 26, change "B8" to --$B_8$--.

Column 7, line 57, change "TiO2" to --$TiO_2$--.

UNITED STATES PATENT AND TRADEMARK OFFICE

CERTIFICATE OF CORRECTION

PATENT NO. : 5,049,205

DATED : September 17, 1991

INVENTOR(S) : Nobuyuki TAKAHASHI, et al.

It is certified that error appears in the above-identified patent and that said Letters Patent is hereby corrected as shown below:

Column 8, line 24, change"NH3" to --$NH_3$-- and "gas In another" to --gas. In another--.

Column 9, lines 28 and 55, changes "TiO2" to --$TiO_2$--.

Column 10, line 19, change "nitrid" to --nitriding--.

Column 10, line 20, change "con" to --containing--.

Column 10, line 23, change "TiO2" to --$TiO_2$--.

Column 12, line 1, change "to ppm" to --to [0] ppm--.

Column 12, line 6, change "to ppm" to --to [0] ppm--.

Signed and Sealed this

Twenty-third Day of March, 1993

*Attest:*

*Attesting Officer*

STEPHEN G. KUNIN

*Acting Commissioner of Patents and Trademarks*